United States Patent [19]

Miyazaki et al.

[11] 4,185,761

[45] Jan. 29, 1980

[54] PRESSURE ROLLER IN SPINNING MACHINE

[75] Inventors: Tsutomu Miyazaki, Kariya; Yoshihisa Suzuki, Chiryu, both of Japan

[73] Assignee: Kabushiki Kaisha Toyada Jidoshokki Seisakusho, Aichi, Japan

[21] Appl. No.: 965,247

[22] Filed: Nov. 27, 1978

[30] Foreign Application Priority Data

Nov. 25, 1977 [JP] Japan ..... 52-141745
Nov. 25, 1977 [JP] Japan ..... 52-158527[U]

[51] Int. Cl.[2] ..... B65H 51/10

[52] U.S. Cl. ..... 226/181; 57/58.95; 226/190; 242/18 R; 242/45

[58] Field of Search ..... 226/91, 181, 183, 186, 226/187, 190; 242/18 R, 18 DD, 18 PW, 45; 57/58.95

[56] References Cited

U.S. PATENT DOCUMENTS

| | | | |
|---|---|---|---|
| 3,355,868 | 12/1967 | Civrny et al. | 57/58.95 |
| 4,041,685 | 8/1977 | Grau et al. | 57/58.95 X |
| 4,060,207 | 11/1977 | Miyazaki et al. | 242/18 R |

*Primary Examiner*—Stanley N. Gilreath
*Attorney, Agent, or Firm*—Wenderoth, Lind & Ponack

[57] ABSTRACT

A pressure roller is generally disposed between the yarn discharge portion of a spinning unit and a yarn oscillating device of a winding unit in a spinning unit. The pressure roller is in contact with a drive roller to form a nip therebetween and is formed with a notch provided in one end edge of the pressure roller to transport the yarn into the nip. The notch intersects the end face of the pressure roller at boundary lines extending from the end edge thereof inwardly.

According to this invention, one of the boundary lines provided on the downstream side of a rotational direction of the pressure roller comprises at least two portions extending out of line, and distances between tangential planes to the two portions of the one of the boundary lines and planes parallel to the tangential planes and including a center of the pressure roller are so selected that the distance with respect to the portion including the outermost end of the one of the boundary lines is larger than that with respect to the portion including the innermost end of the one of the boundary lines.

6 Claims, 16 Drawing Figures

PRESSURE ROLLER IN SPINNING MACHINE

BACKGROUND OF THE INVENTION

This invention relates to a yarn transporting device disposed between a yarn discharge portion of a spinning unit and a yarn oscillating device of a winding unit in a spinning machine, and more particularly to a notch provided in a pressure seller associated with a drive roller to form a gap therebetween into which the yarn is guided to transport the same.

It is a principal object of this invention to provide an improved notch configuration, which prevents increase in tension of a yarn when it is gripped by the notch, thereby decreasing a possibility of yarn breakages.

Another object of this invention is to provide a notch configuration, which allows a yarn to be more surely transferred into a nip between a pressure roller and a drive roller.

Still another object of this invention is to provide a notch configuration which prevents wear of a yarn gripping portion of the notch and enables the notch to be repaired by grinding the pressure roller without deteriorating the gripping function of the notch.

SUMMARY OF THE INVENTION

Briefly, a pressure roller is generally disposed between the yarn discharge portion of a spinning unit and a yarn oscillating device of a winding unit in a spinning unit. The pressure roller is in contact with a drive roller to form a nip therebetween and is formed with a notch provided in one end edge of the pressure roller to transport the yarn into the nip. The notch intersects the end face of the pressure roller at boundary lines extending from the end edge thereof inwardly.

According to this invention, one of the boundary lines provided on the downstream side of a rotational direction of the pressure roller comprises at least two portions extending out of line, and distances between tangential planes to the two portions of one of the boundary lines and planes parallel to the tangential planes and including a center of the pressure roller are so selected that the distance with respect to the portion including the outermost end of one of the boundary lines is larger than that with respect to the portion including the innermost end of one of the boundary lines.

In a preferred embodiment, the other boundary line comprises at least two straight portions or a single curved line so arranged that an angle at which a tangential plane to the outermost end of the other boundary line intersects a tangential line at an intersection of the other boundary line and the end edge of the pressure roller is decreased as small as possible.

In another preferred embodiment, the other boundary line includes a straight portion connected to the end edge and the other boundary line thereby to provide the notch with an additional flat plane extending axially of the pressure roller, and that an intersection of the two boundary lines is positioned on the upstream side of the rotational direction of the pressure roller with respect to a line connecting the center of the pressure roller and an intersection of the other boundary lines and the straight portion.

BRIEF DESCRIPTION OF THE DRAWINGS

This invention will become more readily apparent from the following description of preferred embodiments thereof shown, only by way of example, in the accompanying drawings wherein.

DESCRIPTION OF THE PREFERRED EMBODIMENTS

Figure 1:
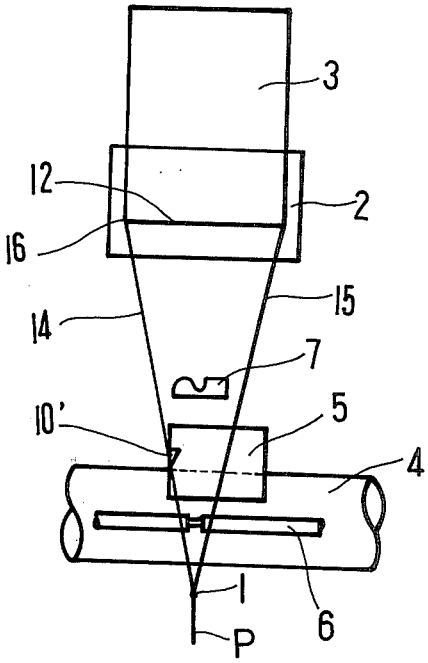
FIG. 1 is a front view showing a yarn transporting device in a spinning machine to which a pressure roller according to the present invention is applicable.

A spinning machine includes a plurality of yarn discharge portions constituting spinning units and a plurality of yarn oscillating devices constituting yarn taking-up units. Between each of the discharge portions and the corresponding oscillating device is disposed a pressure roller which is in contact with a drive roller under pressure and has a notch provided in the circumferential edge thereof to automatically gripe an ended yarn with the notch thereby to facilitate guiding of the ended yarn to a cross wound package on a bobbin. Such a pressure roller is known from U.S. Pat. No. 3,355,868 and shown in FIGS. 1 and 2. In said U.S. patent specification, each spinning unit includes a not shown spinning chamber with a yarn discharge opening 1 from which a yarn P is discharged toward a pair of yarn transporting rollers. The discharged yarn is then taken-up on a cross wound package 3 while being oscillated under the action of a traverse or winding roller 2. The yarn transporting rollers comprise a drive roller 4 and a pressure roller 5. Disposed below the pressure roller 5 is a lower guide 6 associated with an upper guide 7 so that the yarn is guided through the nip 8 between the drive roller 4 and pressure roller 5. In addition, the pressure roller 5 is positioned so that an imaginary plane 11 tangential to the winding roller 2, and passing through the discharge point 1 and surface line 12, intersects the pressure roller 5. When the yarn P is broken, supply of fibers into the rotary spinning chamber is stopped due to the action of a yarn breakage detecting element (not shown), and the broken end of the yarn is wound by the winding roller 2 on the package 3. During repairing of the yarn breakage, the operator unwinds a certain length of yarn P from the package 3 and places the free end of this yarn into the discharge opening 1. Due to suction from the spinning chamber, the free yarn end is fed onto the fiber collecting surface thereof where it is connected with fibers supplied, synchronously with the arrival of the free yarn end onto the collecting surface, into the spinning chamber by a not shown fiber supply means. In synchronism with the above, the operator brings again the package 3 into contact with the drive roller 2 thereby to cause the yarn P to be retransported from the spinning chamber onto the package 3. Thus, the winding operation continues. However, in this condition, the yarn P oscillates between the end positions 14 and 15 on the imaginary plane 11, and therefore when the yarn P comes adjacent the turn-back or end point 16 on the drive roller, i.e. when the yarn P locates adjacent the end position 14, it can be gripped by the notch 10' and automatically guided into the nip 8 between the yarn transporting rollers. Thereafter, the yarn discharged from the discharge opening 1 is taken up while passing through the lower yarn guide 6, nip 8, upper guide 7 and surface line 12.

Figure 2:
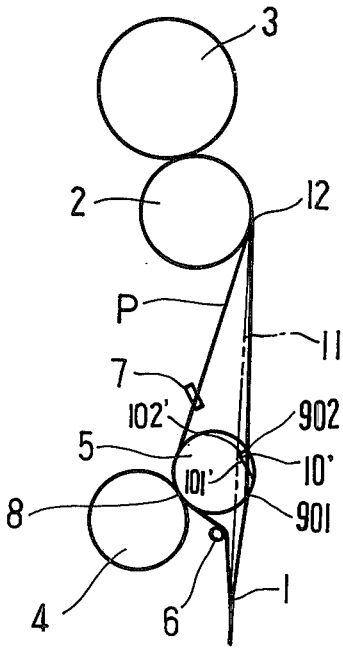
FIG. 2 is a side elevational view of FIG. 1.

However, when the yarn gripped by the notch 10' is fed into the nip 8 between the drive roller 4 and pressure roller 5, there occurs a problem due to increase in tension of the yarn. In FIG. 2, when the path of yarn is changed from a straight path passing through the points 1, 901, 902 and 12 to the other normal path passing through the points 1, 6, 8 and 12, its length between the points 1 and 12 is increased, causing increase in tension of the yarn. The resulting increase of tension becomes high with increase in the thickness of yarn. For example, in the case of 4 or 5 count of yarn, the yarn tension becomes too high, often causing a yarn breakage.

The present invention relates to improvements in configuration of such a notch provided in the above-mentioned pressure roller of the yarn transporting device and provides an improved pressure roller which functions in the most favourable manner.

Figure 3:
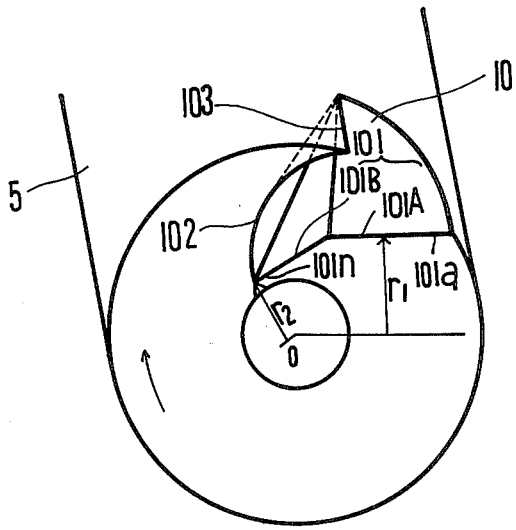
FIGS. 3 to 5 are fragmental perspective views showing different embodiments of the pressure roller according to the present invention.

The first embodiment of this invention shown in FIG. 3 is proposed in order to restrict increase in tension of the yarn P when it is fed into the nip 8 between the drive roller 4 and the pressure roller 5. For this purpose, according to the invention, the length of the yarn path during the time that the yarn once gripped by a notch 10 is slid on the end surface of the pressure roller 5 and guided into the nip 8, particularly the length of the yarn path immediately after the notch gripes the yarn, is minimized. That is, during the transportation of the yarn into the nip 8, the yarn is slid along a boundary line 101 defining the notch 10 from its inner end **101*n* toward outer end 101*a* while being curved by the boundary line 101. At that time, with the boundary line 101 being so formed that a distance from the center O of the pressure roller 5 end face to a point on the boundary line 101 decreases when that point approaches the inner end 101*n*, change in tension of the yarn can be decreased. This is because the yarn is allowered to pass through a position more adjacent the imaginary plane 11 shown in FIG. 2. As shown in FIG. 2, in the known pressure roller, the boundary line 101' of the notch 10' extends straightly until it reaches the boundary line 102'. However, with this invention, in order to cause the inner end 101*n* of the boundary line 101 to more approach to the center 0, the inner side of the notch 10 positioned more inwardly of the pressure roller than the other outer side of the notch 10 comprises at least two planes so that the boundary line 101** consists at least two straight lines or curved lines.

FIG. 3 shows a most simple example, wherein the boundary line 101 consists of two straight lines 101A and 101B. When the pressure roller 5 rotates and the notch 10 grips the yarn therein, the yarn is slid, in a short time, to the inner boundary line end **101*n* positioned at a small diameter $r_2$ portion 1 due to its own tension, and the yarn is firmly engaged in the notch 10. At that time, the yarn curves at a relatively large angle at the inner end 101*n* and therefore is subject to a relatively small sliding resistance. Upon further rotation of the pressure roller 5, the yarn moves away from the inner end 101*n*. However, since the inner end 101*n* is on the relatively small diameter $r_2$ portion from which the yarn starts to move outwardly, the increase in yarn tension is significantly small as compared with the increase in the known pressure roller. A period of time from beginning of the yarn gripping by the notch to a time point immediately thereafter contributes much to the increase in tension of the yarn, although this invention allows the yarn to curve at the small diameter point of the boundary line, resulting in the tension increase being greately restricted. When the path of the yarn changes, i.e. when the yarn slides onto the boundary line 101A, the increase in tension is not so high, because the boundary line 101A approaches a condition that it extends substantially along the direction of yarn travelling and because the yarn tends to slide toward the outer end 101*a*** by means of the yarn tension.

Figure 4:
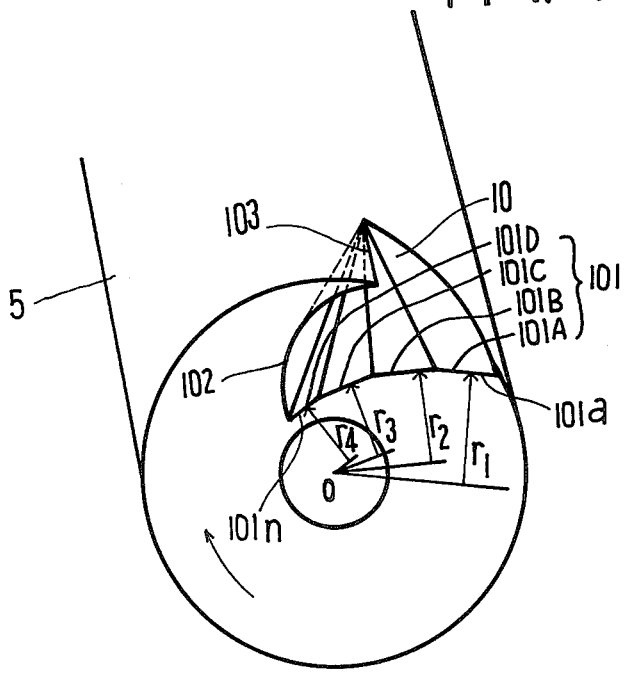

FIG. 4 shows a modification of the notch 10 shown in FIG. 3, wherein the inner side of the notch 10 consists of four planes having respectively boundary lines 101A, 101B, 101C and 101D arranged in relationship shown in FIG. 4 ($r_1 > r_2 > r_3 > r_4$). Since the distances $r_2$, $r_3$ and $r_4$ gradually decrease toward the center O of the pressure roller 5, the yarn is caused to be quickly brought to the inner end **101*n* along the boundary lines 101B, 101C and 101D positioned at the distances $r_2$, $r_3$ and $r_4$ when the notch 10 gripes the yarn to move it in a direction normal to the yarn travelling direction. Since the innermost end 101*n* is positioned on the portion having the minimum distance $r_4$ from the pressure roller 5 center, the displacement of the yarn thereat in the direction normal to the yarn travelling direction is relatively small and therefore the increase in tension is so much limited. Thereafter, the yarn slides from the innermost boundary line end 101*n* toward the outermost end 101*a*. However, since the distances $r_4$, $r_3$ and $r_2$ are decreased in comparison with the known pressure roller, the increase in tension can be significantly limited. Also, when the yarn slides along the boundary line 101A formed at the maximum distance $r_1$, the tension is not so increase, since the boundary line 101A substantially extends along the yarn travelling direction. This causes the yarn to readily and quickly reach the outermost end 101*a* and hence the nip 8 between the drive roller 4 and the pressure roller 5**.

Figure 5:
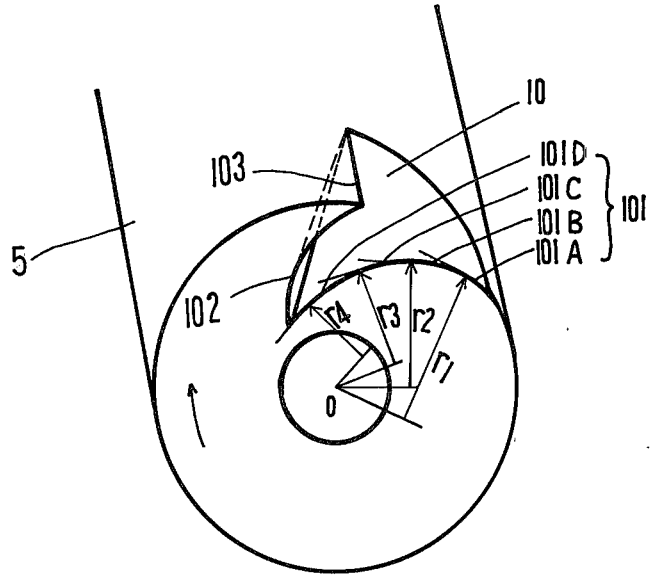

In the embodiment shown in FIG. 5, the boundary line 101 consists of four curved lines 101A, 101B, 101C and 101D, the distances $r_4$, $r_3$, $r_2$ and $r_1$ between the center O and their tangential planes being gradually decreased in these order ($r_1 > r_2 > r_3 > r_4$). These boundary lines 101A, 101B, 101C and 101D function as in the previously mentioned embodiments.

Thus, it is understood that according to the present invention the yarn immediately after it is gripped by the notch 10 can be quickly moved to the innermost end 101*n* by forming the boundary line 101 from at least two straight lines or curved lines and by changing the distances between the pressure roller center O and the tangential planes of the two straight lines or curved lines. Therefore, the yarn can be firmly engaged in the notch 10, and because of the decreased distance at the innermost boundary line end 101*n* with respect to the center O, the small displacement of the yarn can be provided when the yarn changes in its yarn path immediately after it is gripped by the notch, resulting in the increase of the yarn tension being considerably limited. Therefore, it can be expected to prevent occurrence of the yarn breakage even when spinning a large count of yarn which tends to increase in tension.

Another problem encountered when spinning a large count of yarn is poor gripping of the yarn by the notch 10. The invention embodied in the afore-said embodiments has considerably improved the yarn gripping function. However, there is some margin for improvement in the notches shown in FIGS. 3 to 5. In order to provide a good yarn gripping function, the present invention has further improved a notch 10 provided in the pressure roller 5.

Figure 6A:
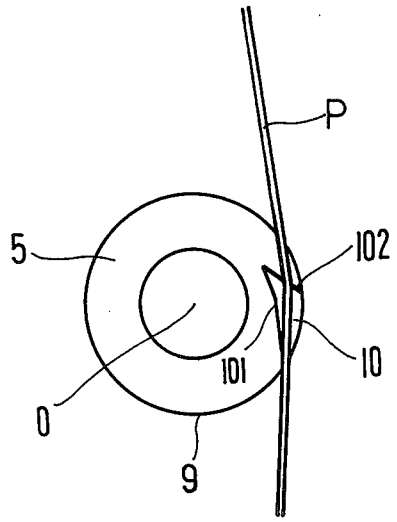
FIG. 6A is an end view of a known pressure roller showing engagement of a yarn with a notch provided in the pressure roller immediately after the yarn is gripped by the notch.
Figure 6B:
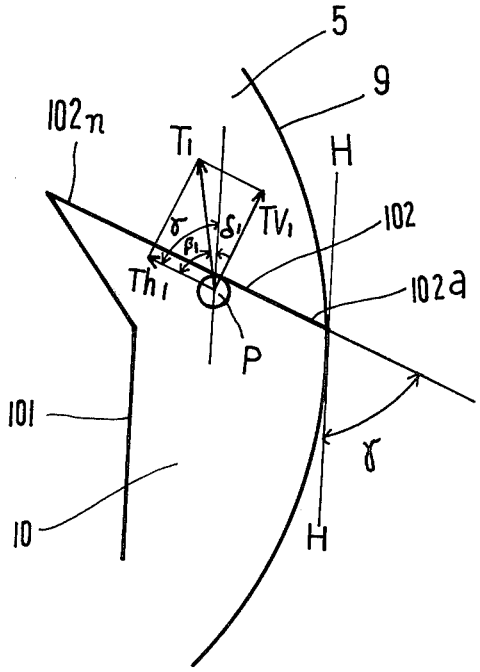
FIG. 6B is a fragmental view showing, on an enlarged scale, the notch of FIG. 6A.

With respect to the conventional notch 10' including only the linear boundary line 102', an analysis of the yarn gripping function thereof will be made as follows. FIGS. 6A and 6B show the condition immediately after the yarn is gripped by the notch. At that time, the yarn P is sliding from the outermost boundary line end 102*a* toward the innermost end 102*n*. A tangent line H—H at the intersection of the boundary line 102 and the circumferential line 9 makes an angle of $\gamma$ with the extension of the boundary line 102. It is assumed that the yarn is in contact with the notch 10 at a position in which it makes an angle of $\delta_1$ with respect to the tangential line H—H, wherein the angle $\delta_1$ is defined by related dimensions of the machine regardless of the notch 10 configuration. That is, the angle $\delta_1$ is constant. In the case where the frictional resistance between the yarn and the pressure roller 5 surface is neglected and assuming the spinning tension of the yarn P is $T_1$, a force $Th_1$ causing the yarn to slide or roll on the boundary line 102 is a component of the spinning tension $T_1$ and can be expressed as:

$$Th_1 = T_1 \cos \beta_1 = T_1 \cos (\gamma - \delta_1)$$

It is understood from this expression that the force $Th_1$ tending to grip the yarn becomes lessened as the angle $\gamma$ grows more and more. Therefore, it is desirable to decrease the value of the angle $\gamma$ as small as possible in order to improve the yarn gripping function of the boundary line 101 at least adjacent the outermost end 101*a*.

Figure 7A:
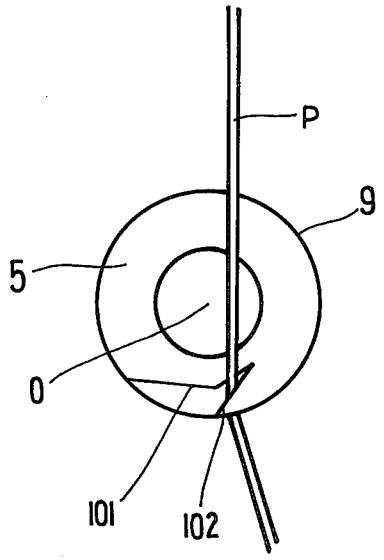
FIGS. 7A and 7B are views, corresponding respectively to FIGS. 6A and 6B, showing engagement of the yarn with the notch during the time that the yarn is in oscillation.
Figure 7B:
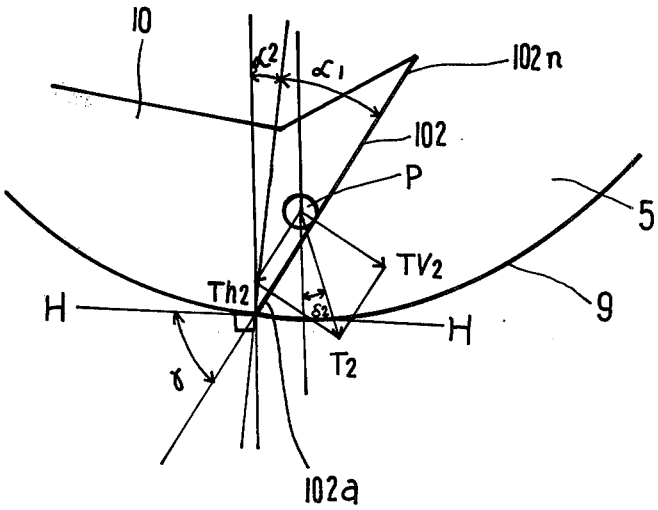

Referring to FIGS. 7A and 7B, there is shown the condition that the yarn gripped by the notch 10 is changing its own path. At that time, the direction of a force $Th_2$ applied on the boundary line 102 by the yarn tension is reversed relative to the previous case. Therefore, assuming the frictional resistance is neglected and the angle $\delta_2$ is constant like the angle $\delta_1$, the force $Th_2$ can be expressed as:

$$Th_2 = T_2 \sin \{\gamma - (\alpha + \delta_2)\}$$

In this case, the force $Th_2$ tends to move the yarn P along the boundary line 102 in the reverse direction so as to disengage from the notch 10, and the more the angle $\gamma$ is, to that extend this force $Th_2$ lessens. Therefore, in this case, it is also necessary to decrease the force $Th_2$ by diminishing the angle $\gamma$ as small as possible. In other words, it is stated that the yarn gripping ability if improved by increasing the angle $\gamma$ at which the tangential line H—H at the intersection between the notch boundary line 102 and the circumferential line 9 intersects with the extension of the boundary line 102.

According to the present invention, the boundary line 102 comprises two or more straight lines or curved lines in order to diminish siad angle $\gamma$ as small as possible.

Figure 8:
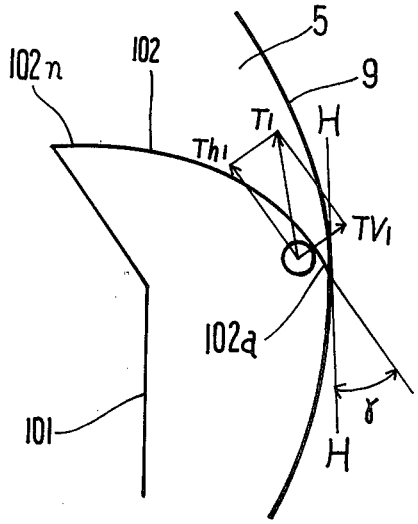
FIG. 8 is a fragmental end view showing, on an enlarged scale, engagement of a yarn with a notch, provided according to this invention in the pressure roller, immediately after the yarn is gripped by the notch.
Figure 9:
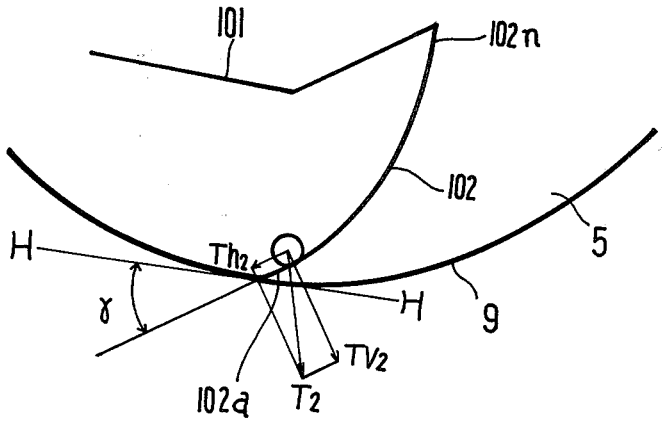
FIG. 9 is a fragmental end view showing, on an enlarged scale, the engagement of the yarn with the notch of FIG. 8 during the time that the yarn is in oscillation.

As clearly shown in FIG. 8, where the boundary line 102 comprises a curved line having a single curvature, the angle $\gamma$ at which a tangential line at a point on the boundary line 102 intersects the tangential line H—H at the intersection between the circumferential edge 9 and the tangential line to the boundary line 102, becomes small as said point approaches the outermost boundary line end 102*a*. Therefore, from said expression regarding the force $Th_1$, it is understood that at the time immediately after the yarn is gripped, the force toward the innermost end 102*n*, i.e. the gripping force is large. Also, even when the yarn path is changing, as shown in FIG. 9, the force $Th_2$ tending to drive the yarn P out of the boundary line 102 becomes small more and more when the yarn approaches to the outermost end end 102*a*, and its value is very small in the case where the spinning tension is the same as the conventional notch employing the linear boundary line 102' so that the yarn P can be firmly gripped by the notch 10. In the embodiments shown in FIGS. 3 to 5, the boundary line 102 has a single curvature.

Although the yarn P passes through adjacent the innermost boundary line end 102*n*, the yarn gripping function is not substantially influenced adjacent the innermost end 102*n*. It is rather preferable to form a large space adjacent the innermost end 102*n*, because the large space gives little resistance to the yarn when it changes the path. That is, at the time that the yarn is adjacent the innermost end 102, the yarn has been completely held by the boundary line 103 on the cylindrical surface of the pressure roller so that the force, especially $Th_1$, applied on the yarn adjacent the innermost end 102 does not substantially influence the yarn gripping function.

Figure 10:
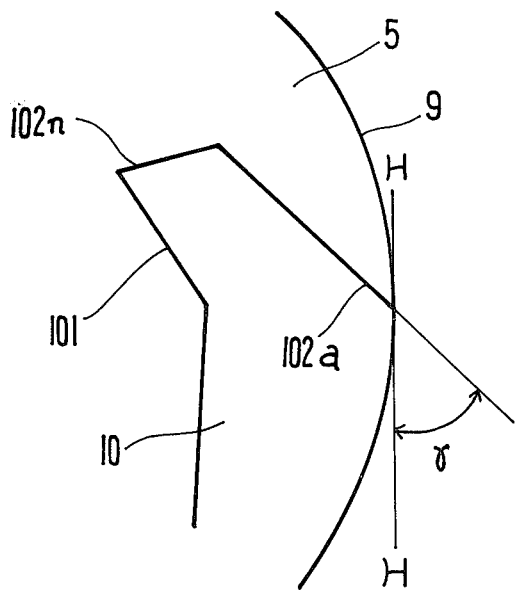
FIG. 10 is a fragmental enlarged end view showing another modification of the pressure roller according to the invention.

FIG. 10 shows a modified notch in which the boundary line 102 comprises two straight lines so that the angle $\gamma$, at which the extension of the straight line including the innermost end 102*a* intersects with the tangential line H—H at the intersection of the circumferential edge 9 and the straight line including the outermost end 102*a*, is decreased. On the other hand, the straight line including the innermost end 102*n* provides a large space formed by the boundary line 101, the straight line including the outermost end 102*a*, and the straight line including the innermost end 102*n*.

It will be understood from the above description that the present invention has provided a yarn transporting device for a spinning machine which can grip the yarn firmly even when the yarn is travelling and oscillating at high speed, and can firmly hold the yarn once gripped. Also, the present invention causes the yarn tension to be decreased as compared with the conventional device so that the invention is preferably applicable to the spinning of a large count of yarn, which tends to be subject to a relatively high tension and involves conditions preventing the yarn gripping.

Figure 11:
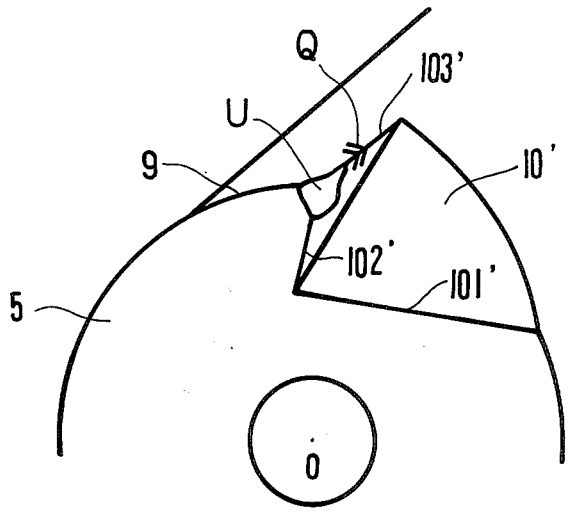
FIG. 11 is a fragmental perspective view illustrating damages caused to the known pressure roller.

The conventional pressure roller 5 encounters with further problem which is to cause the yarn gripping portion in the notch 10 to be worn away and damaged. As shown in FIG. 11, the conventional notch 10' comprises two straight boundary lines 101' and 102' connected to the circumferential edge 9 so that the yarn mainly contact with the boundary line 103' formed on the cylindrical surface of the pressure roller by the plane including the line 102' (except the end face of the pressure roller). Since the boundary line 103' fulfills important duty with respect to the yarn gripping function and an angle formed between the boundary line 102' and the end edge 9 is relatively small, the boundary line 103' is apt to be worn away and damaged as shown at U and Q in FIG. 11 during the time the yarn slides on the boundary line 103', resulting in a poor yarn gripping function. In addition, an abrasion may be generated in the boundary line 103' and therefore the yarn is driven into the abrasion by means of its own tension, resulting in yarn breakage.

The embodiments shown in FIGS. 12 to 15 are adapted to prevent excessive engagement of the yarn with the boundary line 103' in order to remove the disadvantages explained in conjunction with FIG. 11.

In order to improve the yarn gripping function, the angle $\gamma$ at which the extension of the boundary line 102 intersects the tangential line H—H at the intersection of the end edge 9 and the boundary line 102, is decreased. For this purpose, the intersection N of the boundary lines 101 and 102 is positioned on the upstream side of the rotational direction of the pressure roller 5 with respect to the line O-O' connecting the pressure roller center O and the end of the boundary line 102. In this case, the boundary line 102 may comprise either a straight line shown in FIG. 12 or a curved line shown in FIG. 13 so as to provide a large space between the boundary lines 101 and 102. The curved boundary line 102 is preferable because the angle $\gamma$ formed between the tangential line H—H and the tangential line to the boundary line 102 at its end is further decreased.

In order to avoid collecting the load on the boundary line 103 with which the yarn P strongly contacts, a straight boundary line 102A is further provided, which is connected to the end edge 9 and the boundary line 102. Therefore, the yarn gripping portion of the notch 10 further comprises a flat plane extending axially of the pressure roller 5. This flat plane is a quadrilateral having corners a, b, c and d formed by the intersections of the boundary lines 102A, 103, 104 and 105.

Figure 14:
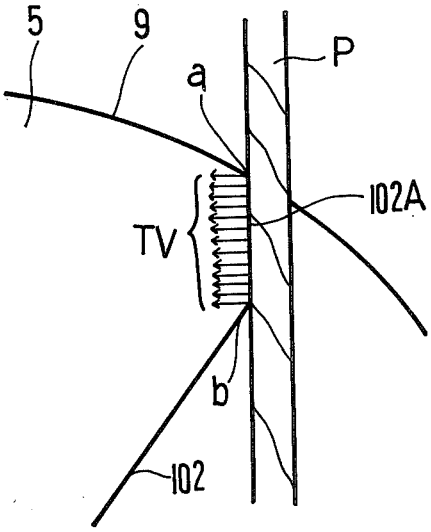
FIG. 14 is an end view of FIG. 13 illustrating the yarn in contact with the notch.

Since the notch has the above-mentioned configuration, it is assured that the yarn is firmly gripped due to the small angle $\gamma$, and the yarn contacts with the flat plane (a, b, c, d) so that the load TV on the flat plane due to contact with the yarn is dispersed equally over the length of the boundary line 102A as shown in FIG. 14, thus preventing the wear of the boundary lines 103 and 105.

Figure 12:
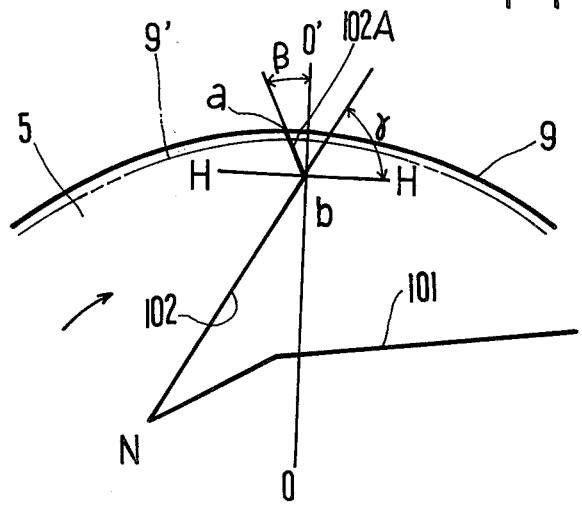
FIG. 12 is a fragmental enlarged end view showing still another modification of the pressure roller according to the invention.
Figure 13:
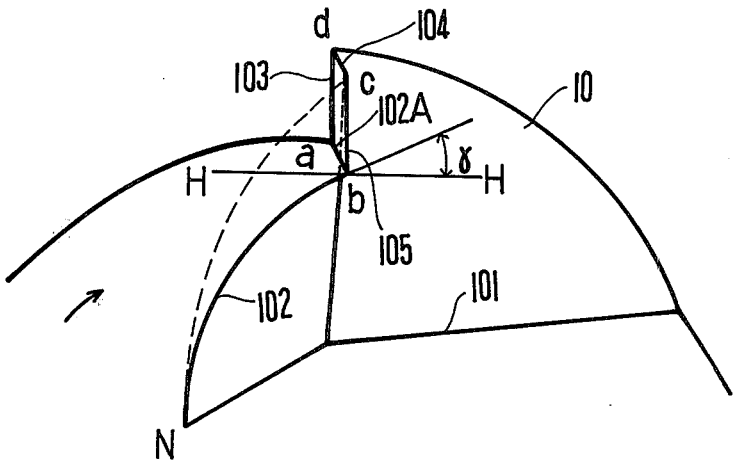
FIG. 13 is a fragmental enlarged perspective view showing a modification of the embodiment shown in FIG. 12.

In FIG. 12, the angle $\beta$ at which the boundary line 102A intersects with the extension of the line connecting the pressure roller center O and the intersection b of the boundary lines 102 and 102A is determined dependent on the diameters of the pressure roller 5, drive roller 4 and winding roller 2 and on the relative positions thereof so as to be within the limits of $90° > \beta \geqq 0°$. Also, it is desirable to determine the angle $\beta$ so that the boundary line 102A is substantially parallel to the travelling direction of the yarn when the same applies the maximum load on the flat plane including the boundary line 102A by the tension of the yarn gripped by the notch 10 in the pressure roller 5.

Although the notch configurations according to the invention diminish the wear of the yarn gripping portion of the notch, there inevitably occurs the wear due to strong tension when spinning a large count of yarn. However, the yarn gripping portion of the quadrilateral (a, b, c, d) can be re-machined by, for example, grinding the cylindrical surface of the pressure roller as shown by an imaginary line 9' in FIG. 12. The machined gripping portion provides a good yarn gripping function. When the yarn P is gripped, it first comes in contact with the boundary line 105 and it is firmly gripped because of the small angle $\gamma$ formed between the boundary line 102 and the tangential line H—H. This point of thime is at the beginning that the yarn changes its path, i.e. of the yarn transportion, so that the yarn tension is not yet so strong. However, the further transportation of the yarn causes the yarn tension to grow more and more. The yarn tension becomes maximum at the end of the yarn transportation and at that time the yarn is in contact with the boundary line 103 while bending at a relatively small angle. Therefore, the boundary line 103 is subject to the wear after all. The worn pressure roller 5 can be easily repaired by grinding the cylindrical surface thereof.

What is claimed is:

1. A pressure roller disposed between a yarn discharge portion of a spinning unit and a yarn oscillating device of a winding unit in a spinning machine, the pressure roller being in contact with a drive roller to form a nip therebetween and formed with a notch provided in one end edge of the pressure roller to transport the yarn into the nip, the notch intersecting the end face of the pressure roller at boundary lines extending from the end edge thereof inwardly, characterized in that one of the boundary lines provided on the downstream side of a rotational direction of the pressure roller comprises at least two portions extending out of line, and that distances between tangential planes to the two portions of the one of the boundary lines and planes parallel to the tangential planes and including a center of the pressure roller are so selected that the distance with respect to the portion including the outermost end of the one of the boundary lines is larger than that with respect to the portion including the innermost end of the one of the boundary lines.

2. The pressure roller as claimed in claim 1, characterized in that each of the two portions comprises a straight line.

3. The pressure roller as claimed in claim 1, characterized in that each of the two portions comprises a curved line.

4. The pressure roller as claimed in claim 1, characterized in that the other of the boundary lines comprises at least two straight portions so arranged that an angle at which a tangential plane to the outermost end of the other boundary line intersects a tangential line at an intersection of the other boundary line and the end edge of the pressure roller is decreased as small as possible.

5. The pressure roller as claimed in claim 1, characterized in that the other of the boundary lines comprises a curved line so arranged that an angle at which a tangential plane to the outermost end of the other boundary line intersects a tangential line at an intersection of the other boundary line and the end edge of the pressure roller is decreased as small as possible.

6. The pressure roller as claimed in any of claims 1–5, characterized in that the other of the boundary lines inlcudes a straight portion connected to the end edge and the other boundary line thereby to provide the notch with an additional flat plane extending axially of the pressure roller, and that an intersection of the two boundary lines is positioned on the upstream side of the rotational direction of the pressure roller with respect to a line connecting the center of the pressure roller and an intersection of the other boundary lines and the straight portion.

* * * * *